US005626338A

United States Patent [19]

Fattebert

[11] Patent Number: 5,626,338

[45] Date of Patent: May 6, 1997

[54] AUXILIARY DRIVING DEVICE FOR THE TRANSPORT OF SHEETS OF PAPER OR CARDBOARD

[75] Inventor: Roland Fattebert, Echallens, Switzerland

[73] Assignee: Bobst SA, Lausanne, Switzerland

[21] Appl. No.: 449,790

[22] Filed: May 24, 1995

[30] Foreign Application Priority Data

May 24, 1994 [CH] Switzerland ..... 01593/94

[51] Int. Cl.[6] ..... B65H 5/02

[52] U.S. Cl. ..... 271/274; 271/245

[58] Field of Search ..... 271/236–238, 271/245–247, 250–252, 272–274

[56] References Cited

U.S. PATENT DOCUMENTS

| | | | |
|---|---|---|---|
| 2,165,161 | 7/1939 | Spiess | 271/251 |
| 4,163,550 | 8/1979 | Armstrong . | |
| 4,762,314 | 8/1988 | Harada . | |

FOREIGN PATENT DOCUMENTS 414690 12/1966 Switzerland .

OTHER PUBLICATIONS

Abstract of Japanese Published Application 61–226453 (Oct. 8, 1986), *Patent Abstracts of Japan*, vol. 11, No. 71 (M–567), Mar. 4, 1987.

*Primary Examiner*—Boris Milef
*Attorney, Agent, or Firm*—Hill, Steadman & Simpson

[57] ABSTRACT

An auxiliary device for transporting of sheets of paper or cardboard arranged in a tilewise stream from a feeding station of a die-cutting press to the die-cutting station of the press includes a driving roller coupled with a rotary brush making up an assembly arranged between the lower section and the upper section of the feed table. The assembly has a pressure arrangement designed to apply the assembly on the upper surface of the stream of sheets. The drive of the rotary brush is obtained from the rotation of the driving roller by means of a toric ring mounted on a circumference of a cylindrical head of an axle for the rotary brush being received on a cylindrical surface formed in a recess of the driving roller. The amount of torque being transferred is obtained by adjusting the position of the rotary brush relative to the driving roller.

5 Claims, 3 Drawing Sheets

AUXILIARY DRIVING DEVICE FOR THE TRANSPORT OF SHEETS OF PAPER OR CARDBOARD

BACKGROUND OF THE INVENTION

The present invention is directed to an auxiliary driving device for transporting of sheets of paper or cardboard, specifically for the transport of sheets of paper or cardboard that are arranged tilewise or in a shingled stream from a feeding station of a die-cutting press to the die-cutting station of such a press.

In the die-cutting presses known up to now, the sheets to be processed are seized from the top of a pile located in the feeding station and delivered tilewise or in a shingled stream onto a feeding table before being introduced into the grippers of the transporting elements of the die-cutting station of the press. The sheets are obviously accurately aligned longitudinally and laterally before being seized by the grippers of the transporting element of the die-cutting press. This alignment occurs at one end of the feeding table and is achieved by front lays or stops and side marks or stops onto which the sheet that is to be introduced into the die-cutting station of the press is to be applied. The current feeding tables generally include a slanted plate which serves as a support for the upper runs of sheet transporting belts arranged side-by-side across the width of the slanted plate. In order to insure the transport of the sheet from the stream onto the feeding table, auxiliary upper pressure means are provided which are fitted on a frame so as to be set in position above the upper run of every sheet transporting belt. These auxiliary pressure means consist of a small belt carrier whose pressure on the stream of sheets to be transported can be adjusted. In order to insure, without damage, the application of a front edge of the first sheet of the stream on the front lays, a preferred embodiment makes use of a rotary brush whose rotation axle is offset longitudinally with regard to the end pulley of the belt carrier. Thus, the rear edge of the first sheet of the stream will not be pushed in the travelling direction by the carrier belt, but only the bristles of the rotating brush, which bristles will give way when the front edge of the first sheet of the stream comes into contact with the front lays. Thus, the sheet will not be deformed or damaged by too strong of a pushing force by the transporting elements.

In this kind of device, it is obviously appropriate to drive the rotary brush. To this aim, the motion of one of the end pulleys of the first carrier is used and transmitted to the brush by means of a driving belt.

These auxiliary pressure means, thus, have several drawbacks. First of all, their construction does not permit the setting of the rotary torque of the brush because of its drive by means of a belt which must necessarily be tight to be efficient. Moreover, these elements require the use of a large number of components, such as pulleys, belts and at least two pressure setting devices, which fact makes their realization particularly expensive. In addition, due to their complexity, the setting for obtaining an adequate transport of the stream of sheets is long and fastidious.

SUMMARY OF THE INVENTION

The object of the present invention is to overcome the above-mentioned drawbacks. To accomplish this object, the invention is directed to an improvement in an auxiliary driving device for the transporting of sheets of paper or cardboard and, specifically, for transporting the sheets of paper or cardboard that are arranged tilewise in a stream from a feeding station of a die-cutting press to the die-cutting station of the press. The driving device includes a driving roller coupled with a rotary brush making up an assembly arranged between a lower section and an upper section of the feed table, said assembly having pressure means for urging the assembly on the upper surface of the stream of sheets.

The improvements are that the drive of the rotary brush is caused by the rotation of a driving roller through a toric ring mounted on a circumference of a cylindrical head of the axle of the rotary brush, said toric ring engaging on a surface of a circular recess located in the driving roller and means for adjusting the position of the rotary brush relative to the driving roller to adjust the pressure on said toric ring.

Other advantages and features of the invention will be readily apparent from the following description of the preferred embodiments, the drawings and claims.

DESCRIPTION OF THE PREFERRED EMBODIMENTS

Figure 1:
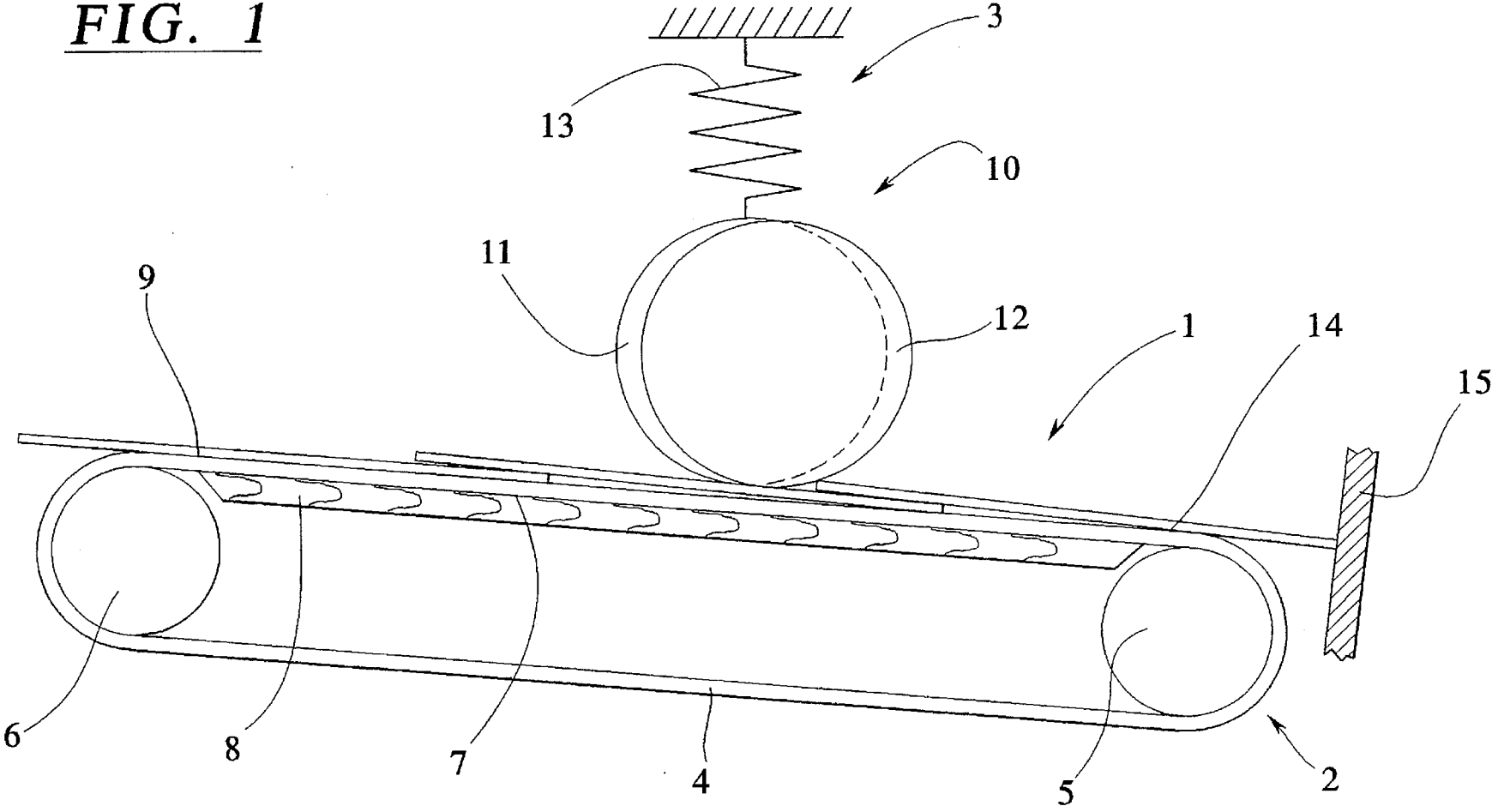
FIG. 1 is a schematic side view of an operation of the feeding tables.

The principles of the present invention are particularly useful in the operation of a feeding table 1. This feeding table 1 includes a lower section 2 and an upper section 3. The lower section 2 consists of a series of lower carrier belts 4 arranged side-by-side across a width of the feeding table 1. These belts are driven by a crosswise roller 5 which is arranged in the front area of the feeding table 1 and the belts pass around another crosswise roller 6 arranged in the rear area of the feeding table 1. The upper runs 7 of the lower carrier belts 4 rest on a board 8. Sheets 9, which are arranged in a shingled or tilewise stream are carried onto the lower section 2 of the feeding table 1 by the infeed elements of the feeder of the die-cutting press, which are not represented in this Figure.

The upper section 3 of the feeding table includes several pressure devices, generally indicated at 10, which each consists of a driving roller 11 and a rotary brush 12. The pressure of the driving roller 11 and of the rotary brush 12 are provided by biasing means, such as a spring 13. A pressure device 10 is mounted, opposite each lower carrier belt 4, on a frame so as to press on the stream of sheets and insure therewith their drive. In the example illustrated in FIG. 1, the front edge of the first sheet 14 of the stream has come into contact with the front lay or stop 15 and, in this position, its rear edge is pushed by the bristles of the rotary brush 12, which is mechanically connected to the driving roller 11. At that time, the driving roller 11 is still driven by the travelling effect of the stream of sheets 9 and transmits its rotary motion to the rotary brush 12. The first sheet 14 having been aligned on the front lays 15, the lays will be retracted and the grippers (not represented) of the transporting element of the die-cutting press will then seize the first sheet by its front edge in order to carry it into the die-cutting station.

Figure 2:
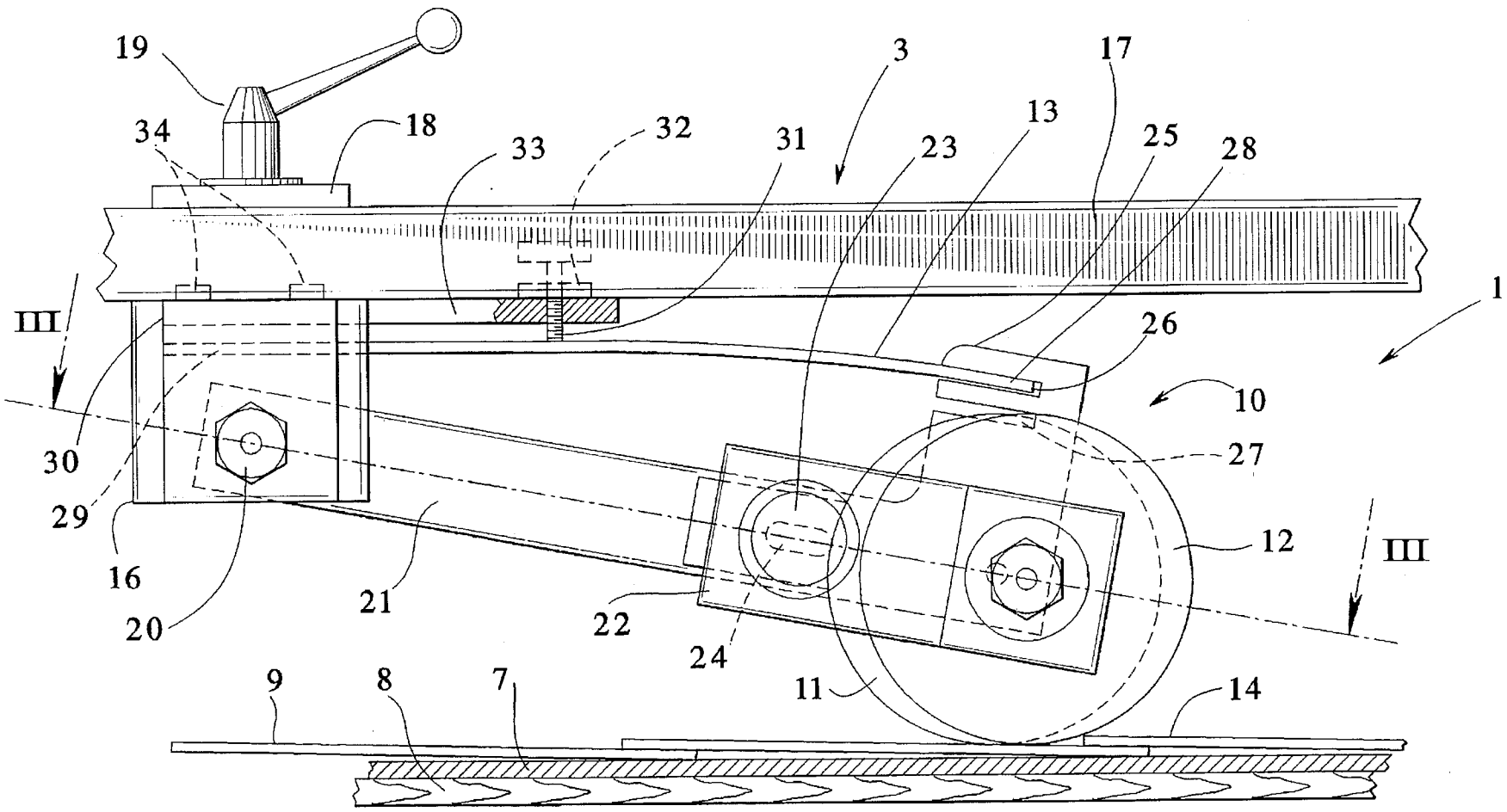
FIG. 2 is a side view of the auxiliary pressure device for transporting sheets of paper or cardboard in accordance with the present invention.
Figure 3:
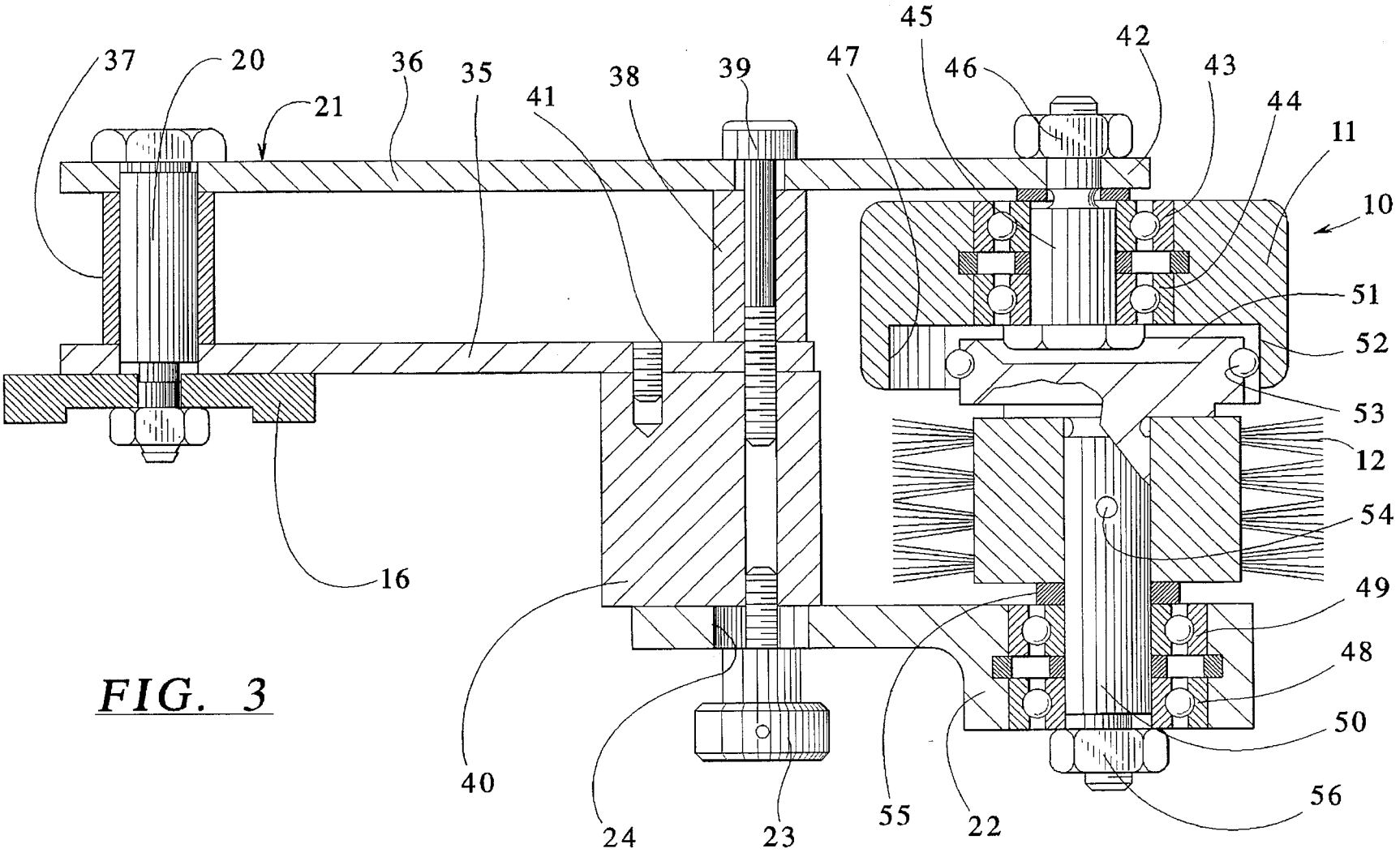
FIG. 3 is a cross sectional view with portions in elevation for purposes of illustration taken along the lines III—III of FIG. 2.

The auxiliary pressure device 10 is shown in greater detail in FIG. 2 and will aid in transport of the stream of paper or cardboard sheets 9 and 14. This device includes a fastening piece 16 which is adjustable along a bar 17 belonging to the upper section 3 of the feeding table 1. This upper section 3 consists of several bars 17 arranged side-by-side above the upper runs 7 of the lower carrier belts 4. The fastening piece 16 can be locked in any position along the bar by means of a small plate 18 tightened by a handle 19 screwed into the fastening piece 16. The fastening piece 16 also has a pivot 20 for supporting one of the ends of a lever 21 which carries, at its other end, the assembly of the driving roller 11 and the rotary brush 12. The rotary brush is mounted on a hub 22 of a plate, as best illustrated in FIG. 3. The plate or bearing 22 is connected to the lever 21 by a knurled knob 23 which extends through an oblong aperture 24. The end of the lever 21, which is arranged in the neighborhood of the driving roller 11 and of the rotary brush 12, has a protuberance 25 with two slits or slots 26 and 27, which may receive an end 28 of a spring 13 consisting of an elastic blade which is anchored at its other end 29 in a block 30 which is part of the fastening piece 16. When the end 28 of the spring 13 is engaged in the upper slot 26, as illustrated, the pressure of the driving roller 11 will be stronger than when the end 28 is engaged in the lower slot 27. In order to finely tune the pressure; on the driving roller 11, an action of a setting screw 31 with a locking nut 32 is used. This setting screw 31 acts on the spring 13 and is screwed in a holdfast element 33 which is mounted on the block 30 by means of screws 34 that tighten, at the same time, the end 29 of the spring 13 onto the block 30.

The disposition of the various elements making up the pressure device 10 will be better understood from the cross sectional view in FIG. 3. The lever 21 consists of a right-hand cheek or plate 35 and of a left-hand cheek 36, separated from one another by sockets or spacer sleeves 37 and 38. The socket 37 acts as a bearing for the pivot 20 and the socket 38 is crossed by a fastening screw 39 that extends into a separating block 40 on which the bearing or plate 22 is mounted by means of the knurled knob 23. The position of the separating block 40 is obtained by a pin 41 which extends from the right-hand cheek 35.

The left-hand cheek 36 with a length a little bit longer than the right-hand cheek 35 carries, at its end 42, the driving roller 11. The driving roller 11 is mounted on ball bearings 43 and 44 which are arranged on the axle 45 which is mounted on the end 42 of the left-hand cheek or plate 36 by means of a nut 46. The driving roller 11 has a circular recess 47 which is concentric with regard to its outer circumference.

The hub portion of the plate 22 receives two ball bearings 48 and 49 which receive an axle 50 of the rotary brush 12. This axle 50 has a cylindrical head 51 with a half-circular annular groove 52 on its outer circumference. A toric ring 53 made of a material with a coefficient of friction corresponding to one for synthetic rubber, such as neoprene, for instance, is received in the groove. The rotary brush 12 is keyed to the axle 50 by means of a pin 54 and its lateral position is determined by a spacing washer 55. The axle 50 of the rotary brush 12 is mounted in the inner races of ball bearings 48 and 49 of the hub of the plate 22 by means of a nut 56.

As may be seen in FIG. 2, the axle 45 of the driving roller 11 and the axle 50 of the rotary brush 12 are offset with regard to one another in such a way that the contact point for the driving roller 11 is situated back from the contact point of the rotary brush 12. The drive of the rotary brush 12 by the rotary motion of the driving roller 11 will be obtained by the action of the ring 53 (FIG. 3) against the cylindrical wall of the cylindrical recess 47, which is located in the driving roller 11. The driving torque of the rotary brush will easily be adjusted to be more or less by moving the bearing or plate 22 in the oblong groove 24 and locking it in its desired position with the knurled knob 23. The dismantling of the rotary brush 12, for instance for replacement after wear of the ring 53, will also be easy since it will only require the unscrewing of the knurled knob 23 to release the plate or bearing 22.

Although various minor modifications may be suggested by those versed in the art, it should be understood that I wish to embody within the scope of the patent granted hereon all such modifications as reasonably and properly come within the scope of my contribution to the art.

I claim:

1. In an auxiliary driving device for the transport of sheets of paper or cardboard that are arranged tilewise in a stream from a feeding station of a die-cutting press to the die-cutting station of the press, said auxiliary driving device including a driving roller, a rotary brush, means for coupling the driving roller to the rotary brush to form an assembly arranged between a lower section and an upper section of a feeding table, said assembly including pressure means for biasing and urging the assembly onto an upper surface of the stream of sheets, the improvements comprising the means for coupling including a toric ring mounted on a circumference of a cylindrical head of an axle of the rotary brush, said toric ring being disposed in a circular recess of the driving roller, and means for adjusting the pressure between the ring and surface of the recess by moving the rotary brush relative to the driving roller.

2. In a device according to claim 1, wherein the assembly of the driving roller and rotary brush is mounted on one end of a lever which pivots around a pivot arranged on a fastening piece adjustably positioned along a bar of an upper section of the feeding table.

3. In a device according to claim 2, wherein the lever consists of a left-hand member at the end of which the driving roller is mounted in a non-adjustable position and of a right-hand member equipped with a separating block on which a support bearing with the rotary brush is adjustably mounted.

4. In a device according to claim 1, wherein the pressure means for biasing the assembly of the driving roller and rotary brush against the upper surfaces of the sheets consist of a spring, said spring being an elastic blade anchored at one of its ends in a block belonging to a fastening piece for adjustably mounting the assembly on a bar of the upper section, the other end of said blade engaging in one of two spaced slots for modifying the pressure of the assembly of the driving roller and rotary brush on an upper surface of the stream of sheets.

5. In a device according to claim 4, which further includes a fine adjustment of the pressure of the assembly of the driving roller and rotary brush on the upper surface of the stream by means including a setting screw acting on the spring, said setting screw being threaded in a holdfast member fitted on the block in which the end of the spring is anchored.

* * * * *